US007462118B2

(12) United States Patent
Tucker, Sr. et al.

(10) Patent No.: US 7,462,118 B2
(45) Date of Patent: Dec. 9, 2008

(54) BACK AND EDGE WEIGHTED FIELD HOCKEY STICKS

(75) Inventors: Richard B. C. Tucker, Sr., Ruxton, MD (US); Katelyn M. Bedwell, Burlington, VT (US); Joanna Kotula, Baltimore, MD (US)

(73) Assignee: STX, LLC, Baltimore, MD (US)

( * ) Notice: Subject to any disclaimer, the term of this patent is extended or adjusted under 35 U.S.C. 154(b) by 0 days.

(21) Appl. No.: 11/501,708

(22) Filed: Aug. 10, 2006

(65) Prior Publication Data

US 2007/0072709 A1 Mar. 29, 2007

Related U.S. Application Data

(63) Continuation-in-part of application No. 11/030,953, filed on Jan. 10, 2005, now Pat. No. 7,201,682.

(60) Provisional application No. 60/534,968, filed on Jan. 9, 2004, provisional application No. 60/707,172, filed on Aug. 11, 2005.

(51) Int. Cl.
*A63B 59/12* (2006.01)

(52) U.S. Cl. ..... 473/560

(58) Field of Classification Search ..... 473/560–563
See application file for complete search history.

(56) References Cited

U.S. PATENT DOCUMENTS 3,649,163 A 3/1972 McCusker
3,897,058 A 7/1975 Koch
3,941,380 A 3/1976 Lacoste
3,971,559 A 7/1976 Diforte, Jr.
D244,790 S 6/1977 Carlson et al.
4,105,205 A 8/1978 Theodores et al.
4,108,436 A 8/1978 Masi
4,130,619 A 12/1978 Held
4,182,512 A 1/1980 Kuebler
4,183,776 A 1/1980 Staub et al.
4,238,262 A 12/1980 Fishel
4,240,630 A 12/1980 Hoffman
4,241,919 A 12/1980 Foreman
4,251,073 A 2/1981 Birdsong, Jr.
4,311,306 A 1/1982 Solloway
4,337,283 A 6/1982 Haas, Jr.
4,358,113 A 11/1982 McKinon et al.

(Continued)

FOREIGN PATENT DOCUMENTS

EP 0 304 324 2/1989

(Continued)

OTHER PUBLICATIONS

International Search Report & Written Opinion, Aug. 23, 2005.

*Primary Examiner*—Mark S Graham
(74) *Attorney, Agent, or Firm*—Paul, Hastings, Janofsky & Walker LLP

(57) ABSTRACT

A field hockey stick including a handle, a throat adjoining the handle, and a head adjoining the throat opposite to the handle. At least one portion of one of the handle, the throat, and the head is hollow. The at least one portion has variable wall thicknesses that enhance the performance and feel of the stick, e.g., providing back weighting and/or edge weighting.

12 Claims, 10 Drawing Sheets

U.S. PATENT DOCUMENTS

| | | | | | |
|---|---|---|---|---|---|
| 4,361,325 | A | * | 11/1982 | Jansen | 473/562 |
| 4,373,718 | A | | 2/1983 | Schmidt | |
| RE31,811 | E | | 1/1985 | Foreman | |
| 4,512,573 | A | | 4/1985 | Coolen | |
| 4,763,900 | A | | 8/1988 | Carr | |
| 4,948,131 | A | | 8/1990 | Nakanishi | |
| 4,984,792 | A | | 1/1991 | Pacanski | |
| 5,088,732 | A | | 2/1992 | Kim | |
| 5,180,163 | A | | 1/1993 | Lanctot et al. | |
| 5,183,264 | A | | 2/1993 | Lanctot | |
| 5,193,246 | A | | 3/1993 | Huang | |
| 5,197,732 | A | | 3/1993 | Lanctot | |
| 5,312,100 | A | * | 5/1994 | Ilacqua et al. | 473/562 |
| 5,380,003 | A | | 1/1995 | Lanctot | |
| 5,417,418 | A | | 5/1995 | Terzaghi et al. | |
| 5,452,889 | A | | 9/1995 | Lewinski et al. | |
| 5,524,884 | A | | 6/1996 | Haines | |
| 5,551,082 | A | | 9/1996 | Stewart et al. | |
| 5,590,875 | A | | 1/1997 | Young | |
| 5,603,498 | A | * | 2/1997 | Crawford et al. | 473/563 |
| 5,655,980 | A | | 8/1997 | Nashif et al. | |
| 5,772,540 | A | | 6/1998 | Keubler | |
| 5,792,011 | A | | 8/1998 | Kuebler | |
| 5,935,029 | A | | 8/1999 | Cyr et al. | |
| 5,964,672 | A | | 10/1999 | Bianchi | |
| 5,980,397 | A | | 11/1999 | Hart et al. | |
| 6,042,485 | A | | 3/2000 | Cheng | |
| 6,077,178 | A | | 6/2000 | Brandt | |
| 6,117,028 | A | | 9/2000 | You | |
| 6,203,455 | B1 | | 3/2001 | Scherubi | |
| 6,241,633 | B1 | | 6/2001 | Conroy | |
| 6,354,958 | B1 | | 3/2002 | Meyer | |
| 6,471,607 | B2 | | 10/2002 | Hsu | |
| 6,625,848 | B1 | | 9/2003 | Schneider | |
| 7,201,682 | B2 | | 4/2007 | Tucker, Sr. et al. | |
| 2002/0037780 | A1 | * | 3/2002 | York et al. | 473/560 |
| 2002/0065154 | A1 | | 5/2002 | Goldsmith et al. | |
| 2003/0004019 | A1 | * | 1/2003 | Lussier et al. | 473/563 |
| 2003/0216197 | A1 | | 11/2003 | LeMire et al. | |
| 2006/0194656 | A1 | * | 8/2006 | Bedwell et al. | 473/560 |

FOREIGN PATENT DOCUMENTS

| | | | |
|---|---|---|---|
| EP | 0 519 312 | | 12/1992 |
| EP | 0 551 483 | B1 | 7/1993 |
| EP | 0 555 666 | A1 | 8/1993 |
| EP | 0 555 666 | B1 | 8/1993 |
| FR | 2 610 835 | | 8/1988 |
| GB | 2 033 238 | A | 5/1980 |
| GB | 2 298 799 | | 9/1996 |
| JP | 08173581 | | 7/1996 |
| JP | 09-322950 | | 12/1997 |
| WO | WO 93/02753 | | 2/1993 |
| WO | WO 98/28052 | | 7/1998 |
| WO | WO 98/47574 | | 10/1998 |
| WO | WO 99/24749 | | 5/1999 |
| WO | WO 01/23047 | | 4/2001 |
| WO | PCT/US03/04502 | | 6/2003 |

* cited by examiner

BACK AND EDGE WEIGHTED FIELD HOCKEY STICKS

This application is a continuation-in-part of U.S. patent application Ser. No. 11/030,953, filed Jan. 10, 2005, which claims the benefit of U.S. Provisional Application No. 60/534,968, filed Jan. 9, 2004, both of which are herein incorporated by reference in their entirety. This application also claims the benefit of U.S. Provisional Application No. 60/707,172, filed Aug. 11, 2005, which is incorporated herein by reference in its entirety.

BACKGROUND

1. Field of the Invention

The present invention relates generally to field hockey sticks, and more particularly, to back and edge weighted field hockey sticks.

2. Background of the Invention

As shown in FIG. 1, a field hockey stick 100 typically has a handle 102, a throat 104, and a head 106. The handle 102 starts at a first distal end of stick 100 and extends to throat 104. The stick 100 then curves at the base of the throat 104 to form the head 106 at the second distal end of stick 100. A horizontal line (such as line 115) drawn through the point at which stick 100 begins to curve can mark the end of throat 104 and the beginning of head 106. The head 106 is also considered the base of the stick 100. The head 106 includes a toe 108 and curves horizontally and upwardly to form toe 108. The front (or left hand side, as shown in FIG. 1) of the stick 100 has a flat playing surface and the back is non-flat (e.g., rounded or curved) and not playable in a game. Generally, the flat playing surface includes all of head 106 and at least a portion of throat 104. All sticks are suitable for "right handed" play.

Traditionally, field hockey sticks have been constructed of relatively standard dimensions, due primarily to widely accepted rules of the game. These rules dictate aspects of the stick such as weight, length, shape, and cross section. As one example, the rules require that the playing portion of the stick have a flat face and that every cross section of the stick be able to pass through a two-inch ring. In meeting these rules, the traditional field hockey stick has typically featured a flat front face and a curved back and back head of a relatively uniform shape.

The total weight of a field hockey stick as defined by widely accepted rules must not exceed 737 grams. Within these parameters, field hockey sticks, including field hockey stick heads that are curved and have rounded backs, have a traditional shape and weight disbursement.

In the game of field hockey, players typically favor passes and shots that are hard and low. Indeed, the more powerful the drive, the better chance the pass or shot has of eluding defenders. This increase in power, however, also increases the chance of losing control of the ball, especially in terms of lofting the ball illegally. These passes and shots are hit from an upright standing position and the ball must travel on or near the ground in a relatively straight line. A miss-hit ball often rises up in the air above knee level, which can result in the loss of possession and can be harmful to other players. Thus a principal object of powerful drives is to keep the ball close to the ground. The object is to hit the ball hard but minimize its loft. Shooting low and hard on goal can significantly increase the chances of scoring, either through deflected shots or from rebounds off of the goalie. Keeping the ball low helps control passes and shots, while not violating game rules against lofted balls, which result in the opposing team gaining possession of the ball. Players therefore prefer field hockey sticks that meet this need.

Field hockey sticks are typically made of wood or composites. As used herein, composites refer to field hockey sticks made by bladder molding or by laying up. Bladder molding processes use an air bladder, a two-part female mold, composite material, and resin. The bladder is inflated, thus creating pressure to force the composite and resin against the mold until it cures, thereby forming a hollow field hockey stick. In laying up composites, sheets of uncured fiber-reinforced thermosetting resin are wrapped around a mandrel, which is then withdrawn to form a hollow tubular lay-up. By either process, traditional, hollow composite field hockey sticks typically have generally constant wall thicknesses. Examples of the materials used in the resin include fiberglass, carbon, and aramid. Composite sticks have been available on the market for several years and have been approved for use in international play for over a year.

It is widely believed that composite sticks generate more powerful drives than wooden sticks. Offsetting this additional power, however, composite sticks, because of their hollow interiors, can vibrate undesirably and provide less feel for the ball. Minimizing these effects would therefore allow players to deliver a more powerful drives without sacrificing comfort or ball control. In addition, the ball tends to bounce off the stick when a player is trying to stop the ball. This is a significant disadvantage, as the player can lose control of the ball and even possession of the ball.

SUMMARY OF THE INVENTION

The present invention provides back and edge weighted field hockey sticks. In an embodiment of the present invention, the interior walls of a typical hollow composite field hockey stick are reshaped to redistribute weight to desired areas of the field hockey stick, such as along the edges of the throat and head in the case of edge weighting, or along the center of the back non-playing side of the stick in the case of back weighting. Unlike conventional composite field hockey sticks, which have wall thicknesses that are relatively constant, the present invention varies the wall thickness to redistribute the weight of the stick and provide desirable playing characteristics such as reduced vibration and enhanced feel for ball contact. In redistributing the weight, the overall weight of the field hockey stick preferably remains the same, to comply with commonly accepted rules of field hockey stick construction. Thus, as thicknesses in some areas of a stick are increased, thicknesses in other areas can be reduced.

In one embodiment of the present invention, the thickness of the interior wall of the round non-playing side of the head and throat is increased to give a field hockey stick a back weighted feel. This back weighting can increase the dead spot on the stick, which is the area on the face of the stick where the ball does not bounce at all when it hits the stick. At the dead spot, substantially all of the energy is absorbed by the stick and essentially no energy is transferred to the ball. This effect occurs because, at this point on the stick, the efficient mass of the stick is equal to the efficient mass of the ball. Another benefit in increasing the dead spot on the stick is that, when hitting the ball, substantially all of the energy is transferred from the stick into the ball, creating a more powerful hit. In this embodiment, the field hockey stick can comprise a head, a throat adjoining the head, and a handle adjoining the throat opposite the head. The throat and head have a playing side (e.g., flat) and a non-playing side (e.g., round or curved). In a cross section of the throat taken perpendicular to the longitudinal axis of the throat, the thickness of the non-playing wall is greater than the thicknesses of the playing wall and the two edge walls. For example, the non-playing wall could be 1/16", 1/8", or 1/4" thicker than the other walls. A similar increase in wall thickness can be provided through the head and/or the handle if desired.

In another embodiment of the present invention, the thicknesses of the interior walls of the edges of the field hockey stick are increased to give a field hockey stick an edge weighted feel. The advantage of a peripheral weighted stick is that the moment of inertia of the stick is increased, which reduces twisting and off-center hits. In essence, a peripheral weighted stick can have a more accurate and controlled hitting surface because the center of gravity can be located on the hitting surface. When the ball is hit off of the center of gravity, it moves in a relatively straight direction away from the point at which contact was made. In this embodiment, the field hockey stick can comprise a head, a throat adjoining the head, and a handle adjoining the throat opposite the head. The throat and head have a playing side (e.g., flat) and a non-playing side (e.g., round or curved). In a cross section of the throat taken perpendicular to the longitudinal axis of the throat, the thicknesses of the two edge walls are greater than the thicknesses of the playing wall and the non-playing wall. For example, the two edge walls could be 1/16", 1/8", or 1/4" thicker than the other walls. A similar increase in wall thickness can be provided through the head and/or the handle it desired.

DETAILED DESCRIPTION OF THE INVENTION

Traditionally the center of gravity in the head of a field hockey stick has been designed so that it is in line with or below the center of gravity of a field hockey ball, when both the head and the ball are resting on the same plane. The circumference of a field hockey ball is typically about 8.8125 to 9.25 inches, with a radius to its center of about 1.40 to 1.47 inches. Therefore, the head of a traditional field hockey stick typically has a center of gravity within about 1.47 inches from the bottom of the head. As used herein, center of gravity refers to the point at which the entire weight of a body may be considered as concentrated so that, if supported at this point, the body would remain in equilibrium in any position. By raising the center of gravity of the head, embodiments of the present invention change the moment of impact on a ball and its resultant launch angle. The higher that the center of gravity of the head is above the center of gravity of the ball, the lower the launch angle on the ball will be.

Embodiments of the present invention raise the center of gravity in a field hockey stick head by one or more of the following methods: 1) removing material from a part of the head; 2) adding material to a part of the head; 3) repositioning or redistributing material in the stick, such as in the areas of the head and the throat; 4) using two or more materials with different mass or density properties in the head; and 5) combinations thereof.

Composite field hockey sticks are traditionally manufactured by a process referred to as bladder molding, which uses an air bladder, a two-part female mold, composite material, and resin. The bladder is inflated, thus creating pressure to force the composite and resin against the mold until it cures. This process results in a hollow hockey stick.

Figure 1:
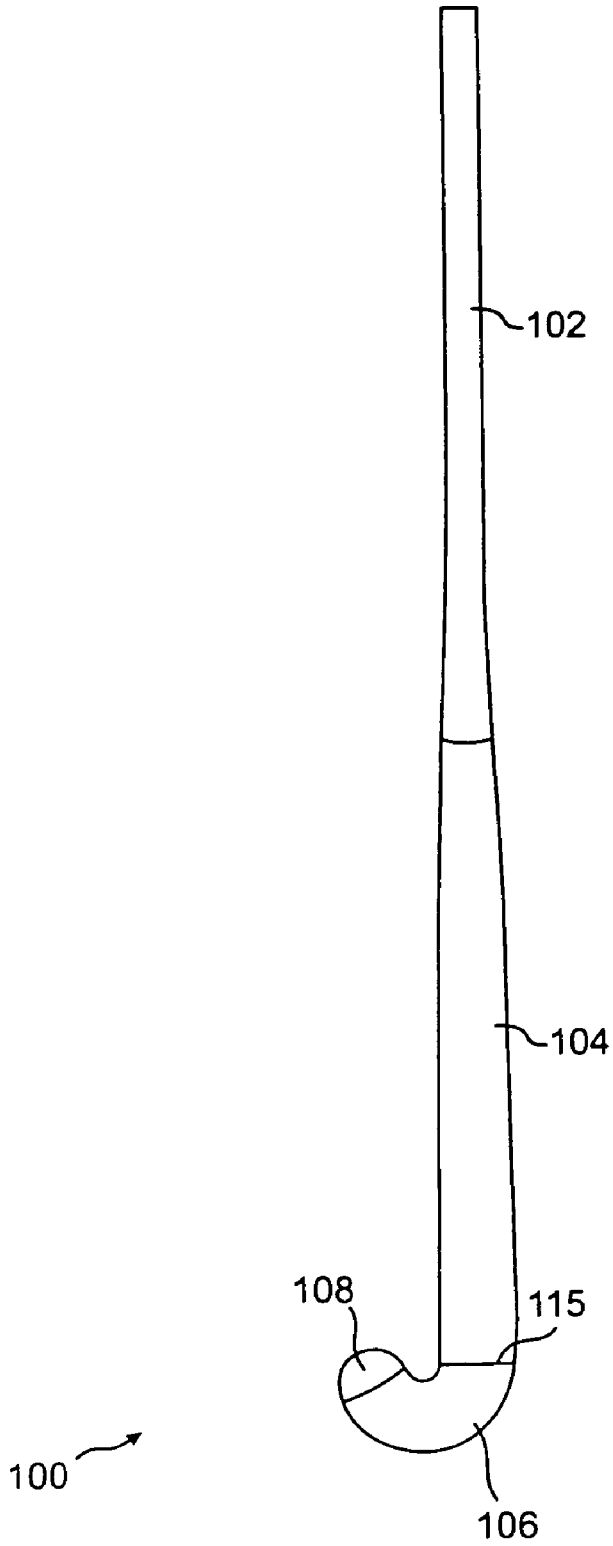
FIG. 1 is a schematic diagram of a conventional field hockey stick.
Figure 2:
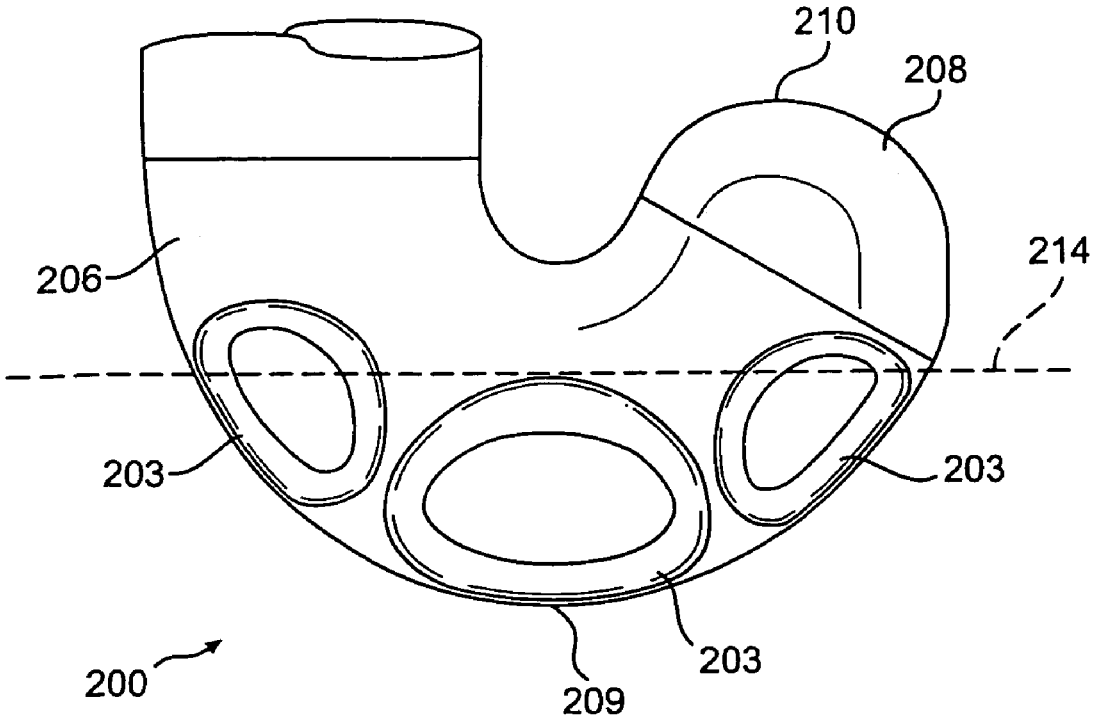
FIG. 2 is a schematic diagram of an exemplary field hockey stick having depressions in its head, according to an embodiment of the present invention.

According to an embodiment of the present invention, FIG. 2 illustrates an example of how to raise the center of gravity of a composite field hockey stick head by taking advantage of the hollow area inside the head. By strategically placing contours in the molds, the present invention shifts where the composite fills the mold. Thus, by not allowing the bottom portion of the head to fill with composite, the mass of the head is disposed higher on the head. To further enhance the reallocation of mass in the head, extra material, such as more resin, can also be added to the head before or after molding.

As shown in the example of FIG. 2, one embodiment of the present invention provides a field hockey stick 200 having a head 206 with one or more depressions 203 in its surface. In this example, head 200 has three depressions 203, which are generally oval in shape. The outside and inside ovals shown for each depression 203 indicate generally where each depression begins to descend (outside line) and then levels out somewhat (inside line) to form the base of the depression.

Figure 3:
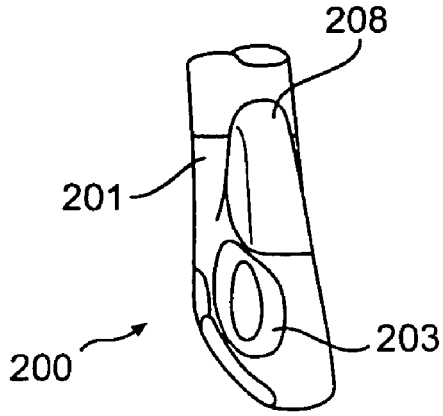
FIG. 3 is a schematic diagram of a side view of the field hockey stick shown in FIG. 2.

FIG. 3 illustrates a side view of field hockey stick 200, showing the depression 203 nearest the toe 208. The depressions could, of course, be formed in many different numbers and shapes, for example, having a single rectangular depression with planar sloping walls, instead of rounded walls.

The depressions 203 in head 206 minimize the mass of the lower portion of head 200, and therefore raise the center of gravity of head 206 to above the traditional center of gravity that is in line with the center of gravity of a field hockey ball. Line 214, which is drawn at roughly the center of gravity of a field hockey ball (e.g., 1.40 to 1.47 inches), represents the line above which the center of gravity of head 206 is disposed, according to an embodiment of the present invention. For example, with depressions 203, the center of gravity of head 206 could be disposed at about 1.5 inches from the extreme end 209 of head 206.

The placement of depressions 203 raises the center of gravity of head 206, such that the center of gravity of head 206 is higher in relation to a ball struck by head 206, in comparison to traditional field hockey sticks. This higher center of gravity helps minimize the loft imparted on the ball. In one embodiment, depressions 203 are disposed within about 1.47 inches from end 209.

According to a particular implementation of the present invention, the center of gravity of head 206 is above a line drawn halfway between the highest point 210 of toe 208 and the extreme end 209 of head 206 opposite to point 210, when the distance between end 209 and point 210 is approximately 3.94 inches (which is the maximum distance allowed by widely accepted rules of field hockey). Such a line would be about 1.97 inches from end 209.

Figure 4:
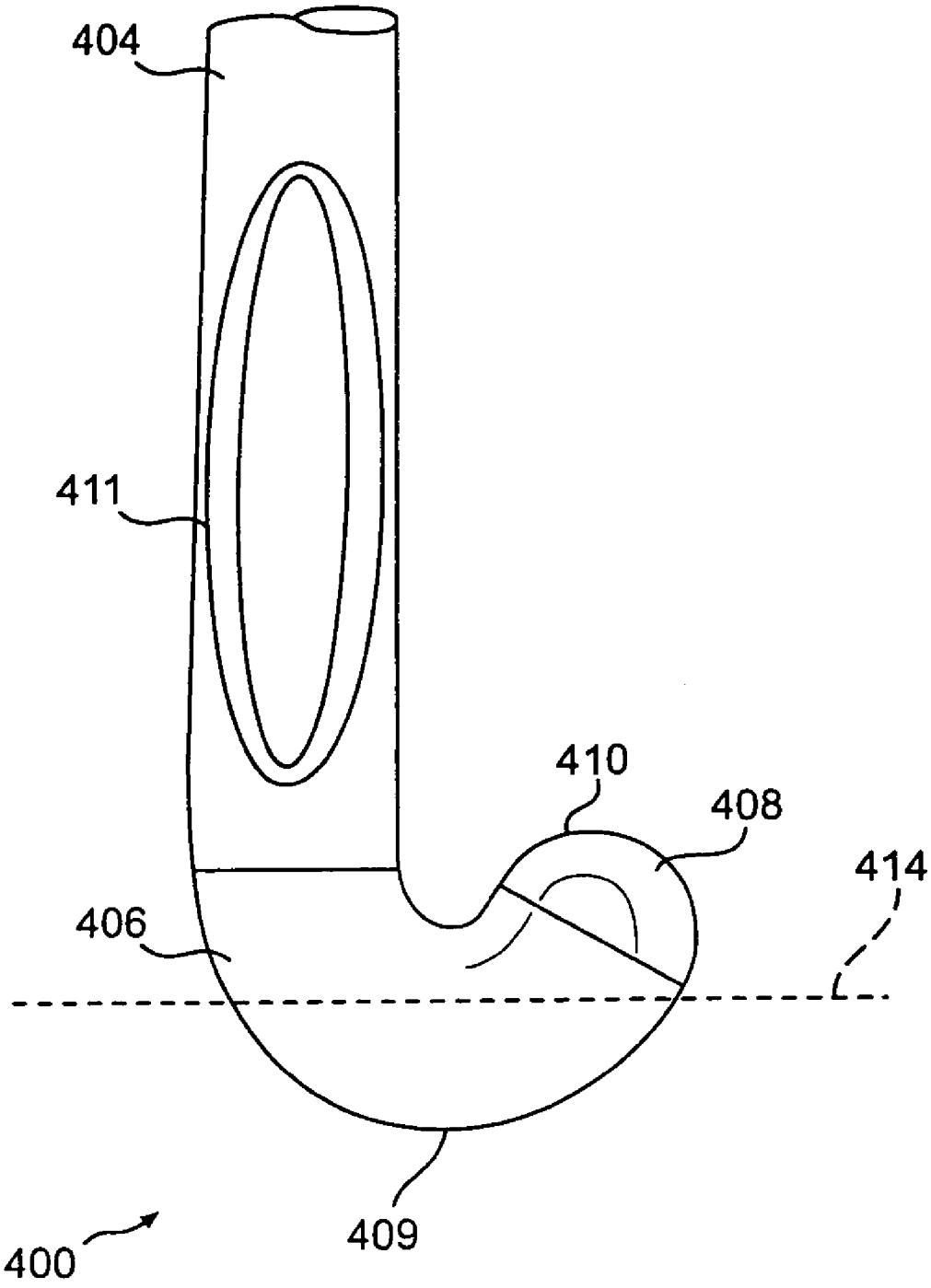
FIG. 4 is a schematic diagram of an exemplary field hockey stick having a depression in its throat, according to an embodiment of the present invention.

FIG. 4 illustrates another embodiment of the present invention in which the mass of the throat of a field hockey stick is reduced and shifted toward the upper portion of the head. As shown in this example, a field hockey stick 400 includes a depression 411 in the surface of its throat 404. Depression 411 can be disposed in throat 404 closer to head 406 than to a handle (not shown) attached to throat 404. Depression 411 can be disposed either in the flat playing side of throat 404 or, as shown in FIG. 4, in the round non-playing side of throat 404.

Figure 5:
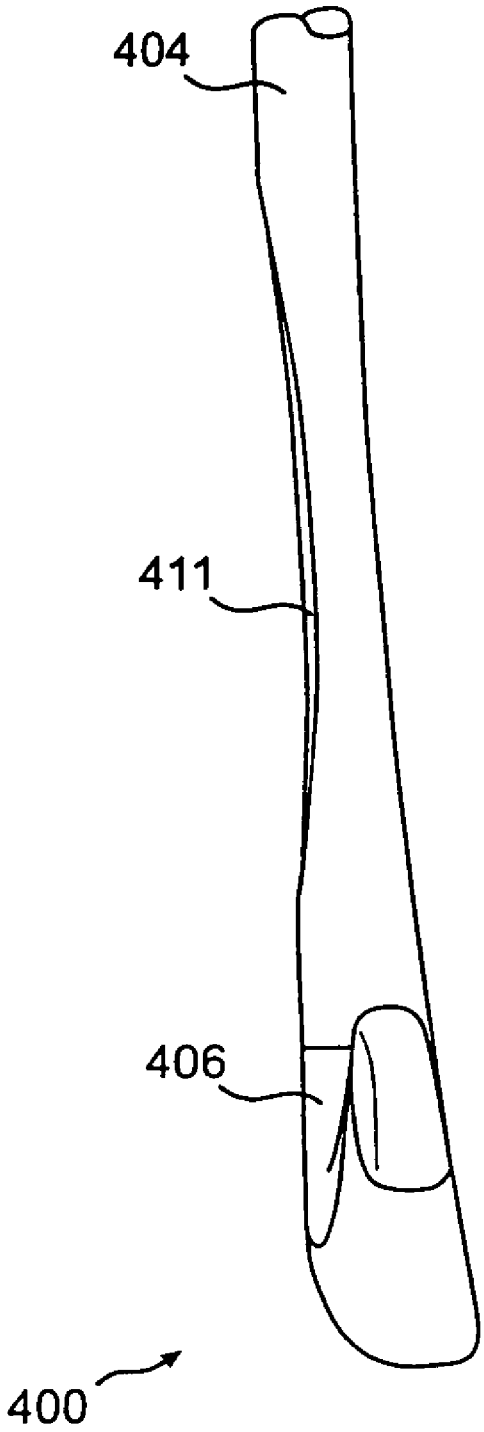
FIG. 5 is a schematic diagram of a side view of the field hockey stick shown in FIG. 4.

Depression 411 could be oval-shaped as shown in the example of FIG. 4. The outside and inside oval-shaped lines shown for depression 411 indicate generally where depression 411 begins to descend (outside line) and then levels out somewhat (inside line) to form the base of the depression 411. FIG. 5 illustrates a side view of field hockey stick 400, further showing the exemplary shape of depression 411, which extends to the edges of the throat and reduces the width of the edges as shown best in FIG. 5. Depression 411 could, of course, be formed in many different numbers and shapes, for example, having multiple tear-shaped depressions.

Disposing depression 411 in throat 404 reduces the mass in throat 404 and redistributes this removed mass to the upper portion of the head 406. Line 414, which is drawn at roughly the center of gravity of a field hockey ball (e.g., 1.40 to 1.47 inches), represents the line above which the center of gravity of head 406 is disposed, according to an embodiment of the present invention. For example, with depression 411, the center of gravity of head 406 could be disposed at about 1.5 inches from the extreme end 409 of head 406. Adding the mass to the top portion of head 406 raises the center of gravity of head 406. Consequently, head 406 can strike a ball with a higher center of gravity and minimize loft on the ball.

According to a particular implementation of the present invention, the center of gravity of head 406 is above a line drawn halfway between the highest point 410 of toe 408 and the extreme end 409 of head 406 opposite to point 410, when the distance between end 409 and point 410 is approximately 3.94 inches (which is the maximum distance allowed by widely accepted rules of field hockey). Such a line would be about 1.97 inches from end 409.

Figure 6:
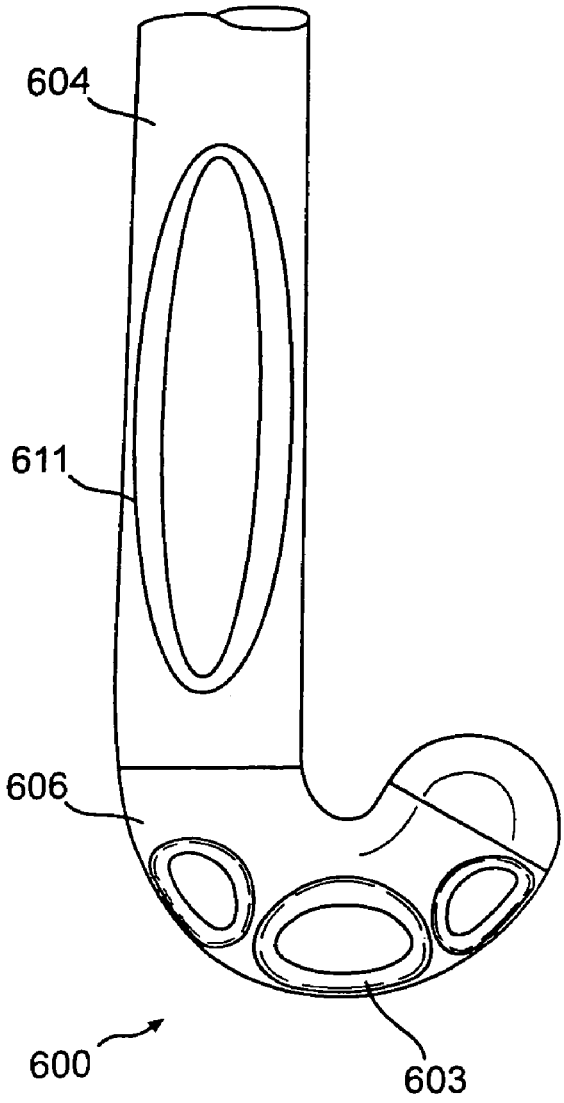
FIG. 6 is a schematic diagram of an exemplary field hockey stick having depressions in its head and a depression in its throat, according to an embodiment of the present invention.
Figure 7:
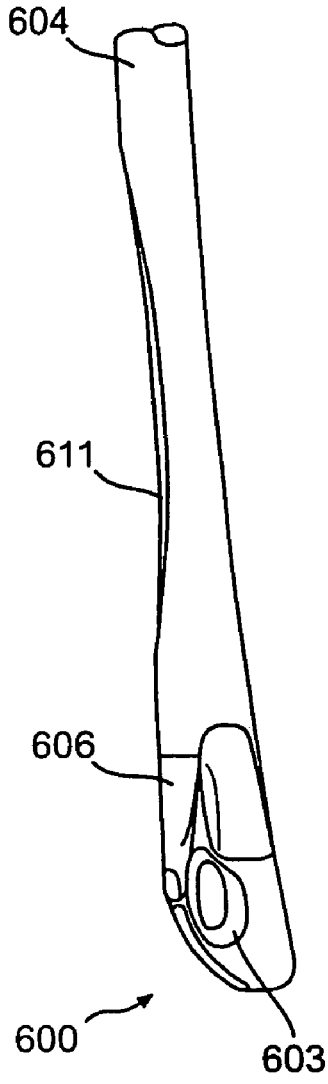
FIG. 7 is a schematic diagram of a side view of the field hockey stick shown in FIG. 6.

FIGS. 6 and 7 illustrate a further embodiment of the present invention in which a field hockey stick 600 has both a depression 611 in its throat 604 and also one or more depressions 603 in its head 606. As discussed above in reference to FIGS. 2-5, depression 611 and depressions 603 redistribute mass of the field hockey stick 600 to the upper portion of its head 606. Having mass redistributed by both depression 611 and depressions 603 accentuates the center of gravity situated in the upper portion of head 606.

Figure 8:
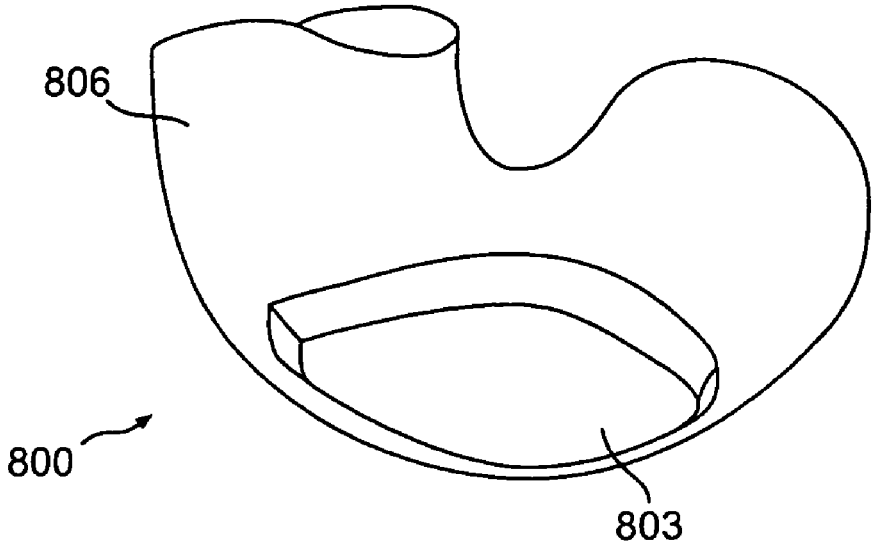
FIG. 8 is a schematic diagram of an exemplary field hockey stick having a single depression in its head, according to an embodiment of the present invention.
Figure 9:
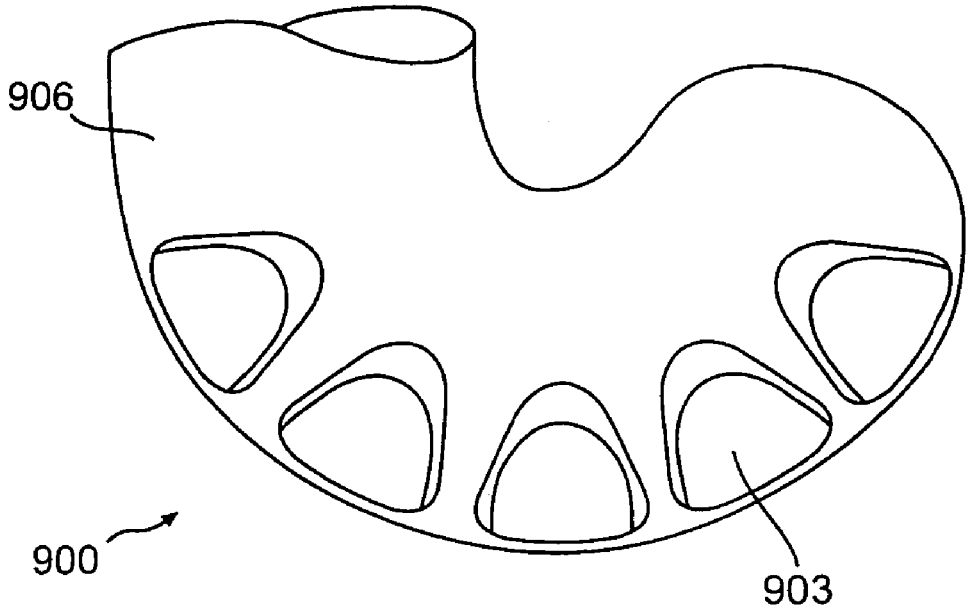
FIG. 9 is a schematic diagram of an exemplary field hockey stick having five roughly triangular depressions in its head, according to an embodiment of the present invention.

FIGS. 8-9 illustrate alternative embodiments of the present invention having different numbers and shapes of depressions on the head of a field hockey stick. For example, FIG. 8 illustrates a field hockey stick 800 having a head 806 with a single irregularly shaped depression 803 in its extreme end (opposite to the handle, not shown). As another example, FIG. 9 illustrates a field hockey stick 900 having a head 906 with five roughly triangular depressions 903.

In a further alternative embodiment, instead of or in addition to removing and redistributing mass of a field hockey stick, mass could be added to the stick. For example, a metal (e.g., lead), thermoplastic elastomer (TPE), or other material could be attached to the upper portion of the head of the stick. For example, a plug made of a second material could be embedded (e.g., by laying up the plug) in the upper portion of the head. This additional material would raise the center of gravity of the head.

Figure 10:
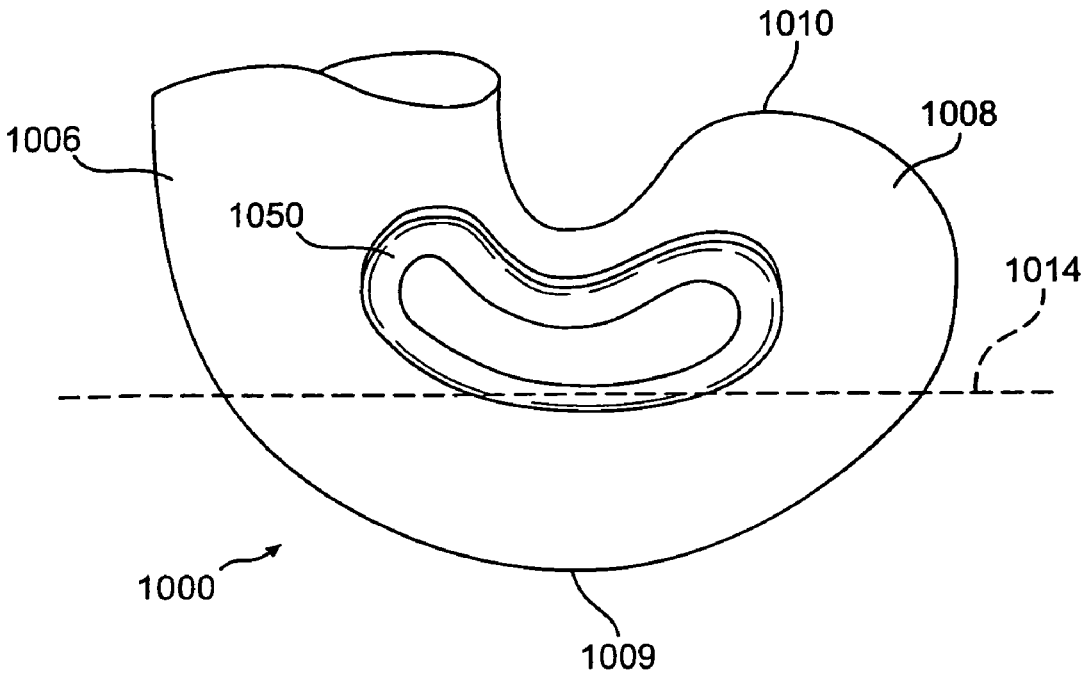
FIG. 10 is a schematic diagram of an exemplary field hockey stick having a mass added to the upper portion of its head, according to an embodiment of the present invention.

FIG. 10 illustrates an example of this embodiment, in which a field hockey stick 1000 has a head 1006 with a mass 1050 added to the upper portion of the head. Line 1014, which is drawn at roughly the center of gravity of a field hockey ball (e.g., 1.40 to 1.47 inches), represents the line above which the center of gravity of head 1006 is disposed, according to an embodiment of the present invention. For example, with mass 1050 added, the center of gravity of head 1006 could be disposed at about 1.5 inches from the extreme end 1009 of head 1006.

According to a particular implementation of the present invention, the center of gravity of head 1006 is above a line drawn halfway between the highest point 1010 of toe 1008 and the extreme end 1009 of head 1006 opposite to point 1010, when the distance between end 1009 and point 1010 is approximately 3.94 inches (which is the maximum distance allowed by widely accepted rules of field hockey). Such a line would be about 1.97 inches from end 1009.

Figure 11:
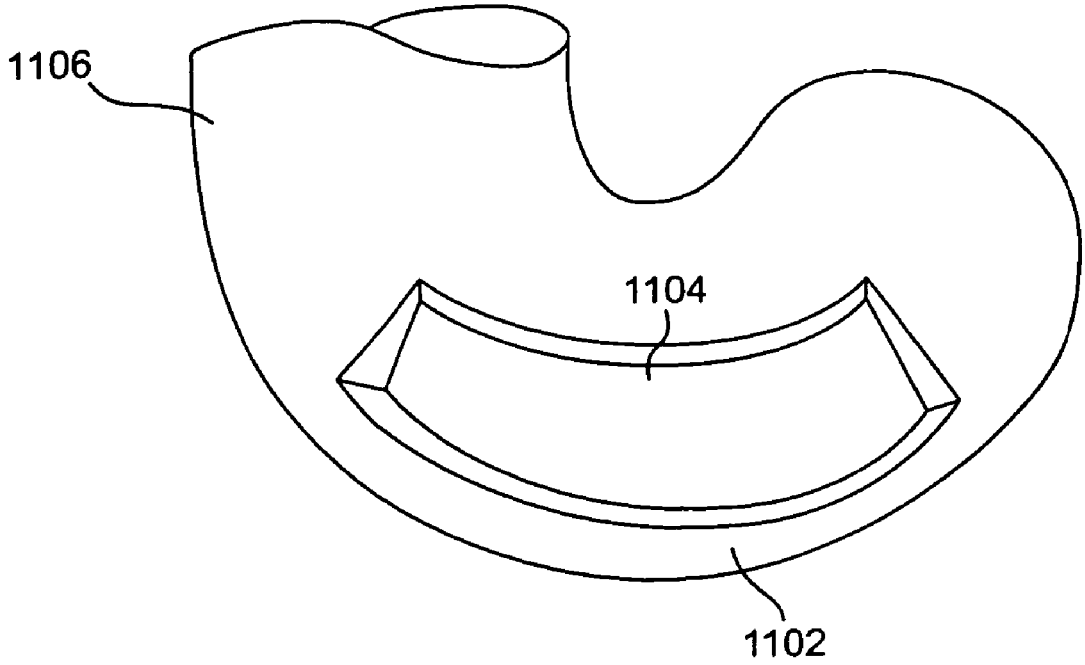
FIG. 11 is a schematic diagram of an exemplary field hockey stick head having a distal member and a depression, according to an embodiment of the present invention.

Another alternative embodiment of the present invention provides a field hockey stick with perimeter weighting, while still raising the center of gravity of the head. This perimeter weighting can improve the feel and control of the stick. As an example, FIG. 11 illustrates a field hockey stick head 1106 having a distal member 1102 and a depression 1104. As described above, depression 1104 enables the redistribution of mass to the upper portion of head 1106 to raise the center of gravity. At the same time, distal member 1102 provides a mass at the end of head 1106 that affords a perimeter weighting for the field hockey stick. Although FIG. 11 shows distal member 1102 in one particular form, many different forms of perimeter weight could, of course, be used, such as flanges, ribs, rims, or plugs. Plugs could be made, for example, of material heavier than the remaining material of the head.

An embodiment of the present invention uses composite materials to construct a field hockey stick having a top weighted head. The composites enable a gradual redistribution of the mass of the field hockey stick, while still providing the requisite degree of strength in the areas from which mass is moved. For example, with the embodiment providing a depression in surface of the round throat back, the mass in the throat can be moved downward to the head with gradual, undulating shapes, leaving a relatively thin area (e.g., thin wall thickness and/or thin edge width as shown, for example, in FIGS. 5 and 7) where the mass is removed that is still structurally strong enough to withstand the rigors of the game. The gradual reshaping and redistributing of material also enable the provision of cross sectional dimensions that comply with the traditional two-inch ring test.

Although discussed primarily in the context of composite field hockey sticks, one of ordinary skill in the art would appreciate that the present invention could apply equally well to field hockey sticks made of other materials, such as wood. In such cases, the throat and head depression(s) would be formed as appropriate for the material. For example, depressions could be carved out of a traditional wood field hockey stick.

A further embodiment of the present invention achieves a higher center of gravity by varying the material composition of the head. For example, the lower portion of a head could be made of a first material, and the upper portion of the head could be made of a second material that is heavier than the first material. In this manner, the center of mass or gravity could be raised on the head without necessarily using depressions (as in FIG. 2) or adding a mass (as in FIG. 10). In the case of a composite stick, for example, lighter fibers could placed in the lower portion of the head, with heavier fibers located in the upper portion of the head. Heavier materials could also be laid up within the fibers to provide areas of greater mass in the upper portion of the head. Similarly, plugs made of heavier or lighter materials could be strategically positioned in the head to provide a raised center of gravity.

Thus, the top weighted field hockey sticks of the present invention provide a player with improved comfort, feel, and playability. In particular, the present invention raises the center of gravity of a field hockey stick head to minimize loft and impart an improved feel when striking a ball with the stick.

In accordance with another aspect of the present invention, mass may be redistributed toward the back, non-playing side of the field hockey stick (back weighting) or toward the edges of a field hockey stick (edge weighting). For example, the mass 1050 in FIG. 10 increases the wall thickness of the non-playing side resulting in a back weighted field hockey stick. If the mass is positioned more centrally than shown in FIG. 10, this back weighting is provided without necessarily being top weighted. A mass similar to mass 1050 could also be applied to the non-playing side of the throat, aligned with the longitudinal axis of the throat, to provide back weighting in that area.

Likewise, additional mass may be placed along the edges of the stick, for example in the throat or head, resulting in increased edge wall thicknesses and an edge weighted field hockey stick. For example, in FIG. 11, the depression 1104 may be configured so that portions of the non-playing side wall or the edge wall have increased thickness, such as portion 1102, resulting in an edge weighted field hockey stick. Where edge weighting is effected in the head of the field hockey stick, the effects can be similar to perimeter weighting. Moreover, a single depression centered in the back of the head, similar to the depressions 203 described in the embodiments shown in FIGS. 2 and 3, could be used to redistribute mass to the perimeter or edges of the head. As another example, with reference to FIG. 5, in redistributing mass from the throat 404 to the upper portion of head 406 by virtue of depression 411, mass can also be redistributed to the walls of the edges of the throat around depression 411, to increase the wall thickness and provide edge weighting in that area. Further embodiments of the present invention designed to provide back weighted and edge weighted field hockey sticks are described below.

Unlike traditional, hollow composite field hockey sticks having generally constant wall thicknesses, embodiments in accordance with this aspect of the present invention vary the wall thickness to redistribute the weight of a field hockey stick. This weight redistribution provides different performance characteristics, especially in terms of how the field hockey stick feels to a player when the stick contacts a ball. Preferably, this weight redistribution is accomplished without changing the overall weight of the field hockey stick, to ensure compliance with widely accepted field hockey rules limiting the weight of sticks.

An embodiment of the present invention modifies conventional composite manufacturing processes to provide varying wall thicknesses. With laying up processes, for example, a mandrel around which resin is wrapped can be configured with depressions on certain sides, which increase the thickness of the walls on those sides. Alternatively, an ordinary mandrel can be used and more resin can be applied to one side of the mandrel. As another example, with a bladder molding process, more resin can be applied to certain walls of the mold to create different wall thickness when the air bladder is inflated and forces the resin against the mold.

Figure 12A:
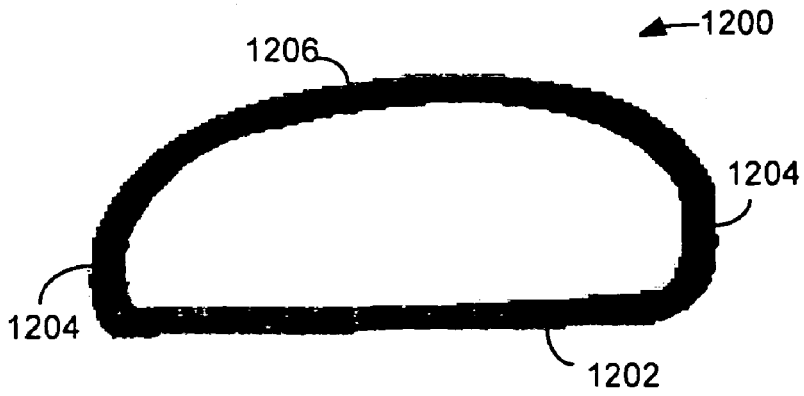
FIG. 12A is a schematic diagram illustrating a cross sectional view of a conventional hollow composite field hockey stick.
Figure 12B:
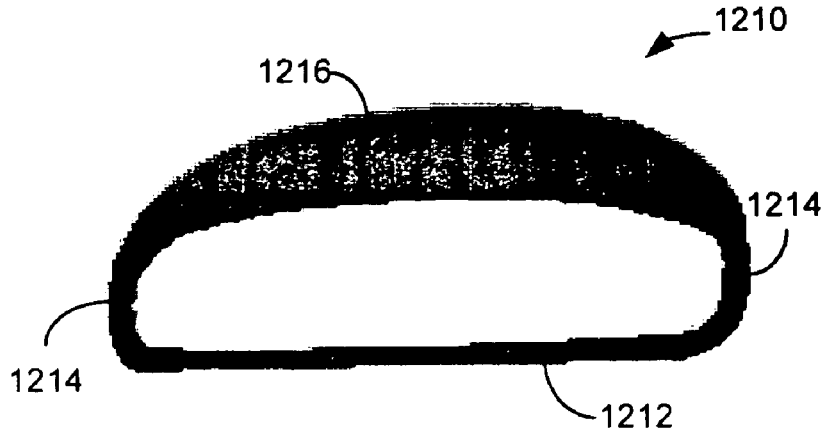
FIG. 12B is a schematic diagram illustrating a cross sectional view of an exemplary back weighted field hockey stick, according to an embodiment of the present invention.
Figure 12C:
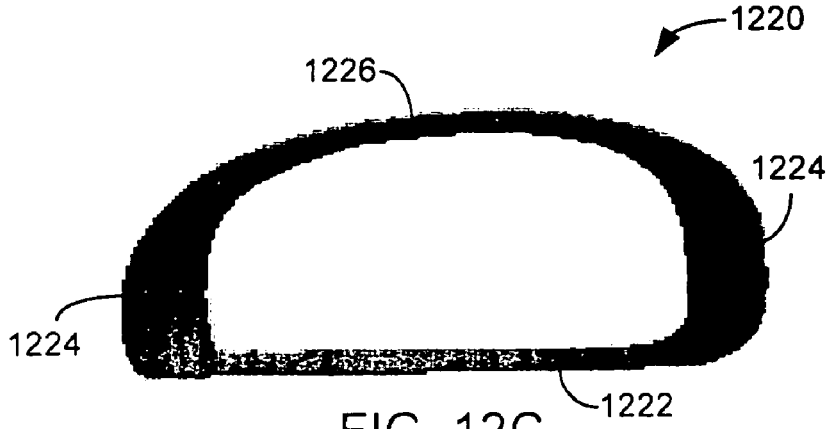
FIG. 12C is a schematic diagram illustrating a cross sectional view of an exemplary edge weighted field hockey stick, according to an embodiment of the present invention.

FIGS. 12A-12C illustrate how embodiments of the present invention compare to a conventional hollow composite field hockey stick. FIG. 12A illustrates a cross sectional view of a conventional hollow composite field hockey stick 1200. As shown, stick 1200 includes a front flat playing side 1202, two edges 1204, and a back round non-playing side 1206, all of generally the same wall thickness.

In contrast, FIG. 12B illustrates a cross sectional view of an exemplary back weighted field hockey stick 1210, according to an embodiment of the present invention. As shown, stick 1210 includes a front flat playing side 1212, two edges 1214, and a back round non-playing side 1216. The wall of the back round non-playing side 1216 is thicker (e.g., approximately 1/16" to 1/4" thicker or approximately 1½ to 2½ times thicker) than the other sides because the mass from the other sides has been redistributed to the back round non-playing side 1216. This mass redistribution can be seen by comparing the greater wall thicknesses of sides 1202 and 1204 of FIG. 12A to the smaller wall thicknesses of sides 1212 and 1214 of FIG. 12B. In one embodiment, the cross section of FIG. 12B is provided in the throat of a field hockey stick, approximately 4 inches above the toe.

FIG. 12C illustrates a cross sectional view of an exemplary edge weighted field hockey stick 1220, according to an embodiment of the present invention. As shown, stick 1220 includes a front flat playing side 1222, two edges 1224, and a back round non-playing side 1226. The walls of the two edges 1224 are thicker (e.g., approximately 1/16" to 1/4" thicker or approximately 1½ to 2½ times thicker) than the other sides because the mass from the other sides has been redistributed to the edges 1224. This mass redistribution can be seen by comparing the greater wall thicknesses of sides 1202 and 1206 of FIG. 12A to the smaller wall thicknesses of sides 1222 and 1226 of FIG. 12C. In one embodiment, the cross section of FIG. 12C is provided in the throat of a field hockey stick, approximately 4 inches above the toe.

One of ordinary skill in the art will appreciate that, although both edges 1224 are shown in the figures as being of equal thickness, one or the other of the edges 1224 may be thicker than each of the playing side 1222 and the non-playing side 1226. Moreover, both edges 1224 may be thicker than each of the playing side 1222 and the non-playing 1226, while one of the edges 1224 is thicker than the other edge 1224.

The variable wall thicknesses of FIGS. 12B and 12C can be provided along portions of a field hockey stick or along the entire length of the stick. For example, the back weighted cross section of FIG. 12B could be provided along the head, the throat, the handle, or combinations thereof. Likewise, the edge weighted cross section of FIG. 12C could be provided along the head, the throat, the handle, and combinations thereof. In addition, different wall thicknesses could be provided at different axial locations along the length of the stick. For example, the head of a field hockey stick could have the edge weighted cross section of FIG. 12C, and the throat and handle of the same stick could have the back weighted cross section of FIG. 12B. As another example, the head and handle of a field hockey stick could have the back weighted cross section of FIG. 12B, and the throat of the same stick could have the edge weighted cross section of FIG. 12C. Indeed, as one of ordinary skill in the art would appreciate, a field hockey stick according to the present invention could have any number and combination of variable wall thickness cross sections.

Figure 12D:
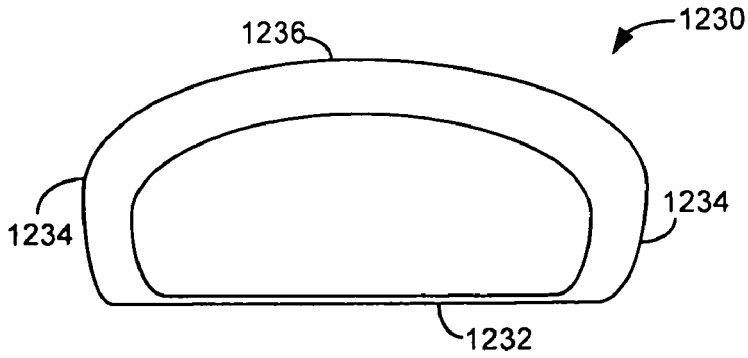
FIG. 12D is a schematic diagram illustrating a cross sectional view of an exemplary back and edge weighted field hockey stick, according to an embodiment of the present invention.

Other combinations may include integrating the back weighted cross section of FIG. 12B with the edge weighted cross section of FIG. 12C such that a portion of a field hockey stick has a cross section having edge walls and a back wall that are each thicker than the playing side wall. As an example, FIG. 12D illustrates a cross sectional view of an exemplary edge weighted field hockey stick 1230, according to an embodiment of the present invention. As shown, stick 1230 includes a front flat playing side 1232, two edges 1234, and a back round non-playing side 1236. The walls of the back non-playing side 1236 and the two edges 1224 are thicker than the front playing side 1232 because the mass from the front playing side 1232 has been redistributed. This mass redistribution can be seen by comparing the greater wall thickness of side 1202 of FIG. 12A to the smaller wall thickness of side 1232 of FIG. 12D. In one embodiment, the cross section of FIG. 12D is provided in the throat of a field hockey stick, approximately 4 inches above the toe.

FIGS. 12B-12D illustrate field hockey sticks having wall thicknesses that gradually transition between each other. For example, in FIG. 12B, starting from a minimum thickness in edges 1214, the wall thickness gradually increases in between edges 1214 to non-playing side 1216, and continues to increase until reaching a maximum thickness in non-playing side 1216. Similarly, in FIG. 12C, the wall thickness starts at a minimum thickness in playing side 1222, gradually increases in between the playing side 1222 and the edges 1224 until it reaches a maximum thickness in edges 1224, and then decreases in between the edges 1224 and the non-playing side 1226, until reaching a minimum thickness in non-playing side 1226. The relative thicknesses discussed above, both proportionally and in nominal dimensions, can be defined in terms of these maximum and minimum thicknesses.

In addition, although FIGS. 12B-12D illustrate field hockey stick cross sections in which wall thicknesses gradually transition between the different walls, one of ordinary skill in the art would appreciate that the changes in wall thickness could be more abrupt. For example, the interior faces of the walls could be squared off. In addition, the exterior faces of the walls could be squared off, instead of being round as shown in the figures.

Figure 13:
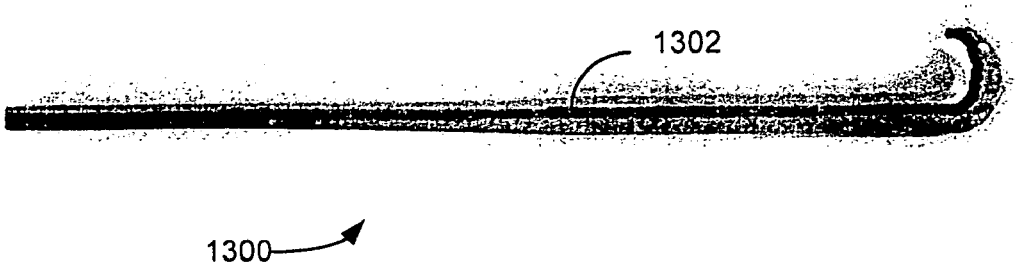
FIG. 13 is a schematic diagram that graphically illustrates an exemplary back weighted field hockey stick having an increased wall thickness on the back non-playing side of the stick, according to an embodiment of the present invention.
Figure 14:
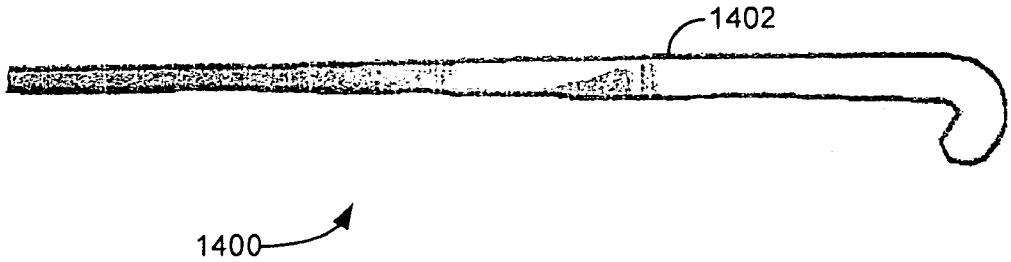
FIG. 14 is a schematic diagram that graphically illustrates an exemplary edge weighted field hockey stick having increased wall thickness on the edges of the stick, according to an embodiment of the present invention.

FIGS. 13 and 14 graphically illustrate general locations of increased wall thickness to provide exemplary back and edge weighted field hockey sticks, respectively. As shown in FIG. 13 an exemplary back weighted field hockey stick 1300 can have an increased wall thickness on the back non-playing side of the stick, as represented by the line 1302. In this example, the increased wall thickness on the back of the stick is provided through the head, the throat, and the handle. In an alternative embodiment, as discussed above, the increased wall thickness on the back of the stick could be provided in only a portion of the stick, for example, only in the head and a portion of the throat.

As shown in FIG. 14, an exemplary edge weighted field hockey stick 1400 can have increased wall thickness on the edges of the stick, as represented by line 1402. In this example, the increased wall thickness in the edges of the stick is provided throughout the head, the throat, and the handle. In an alternative embodiment, as discussed above, the increased wall thickness in the edges of the stick could be provided in only a portion of the stick, for example, only in the head and a portion of the throat.

An embodiment of the present invention uses composite materials to construct back and edge weighted field hockey sticks. The composites enable a gradual redistribution of the mass of the field hockey stick, while still providing the requisite degree of strength in the areas from which mass is moved. For example, with the embodiment providing an increased wall thickness for the back non-playing side of the throat, the mass in the throat can be moved away from the other sides and to the back with gradual shapes, leaving the other sides thinner area but still structurally strong enough to withstand the rigors of the game. The gradual reshaping and redistributing of material also enables the provision of cross sectional dimensions that comply with the traditional two-inch ring test.

Although discussed primarily in the context of composite field hockey sticks, one of ordinary skill in the art would appreciate that the present invention could apply equally well to hollow field hockey sticks made of other materials, such as wood. In such cases, the wall thicknesses would be formed as appropriate for the material. For example, walls could be carved out of wood.

The foregoing disclosure of embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A field hockey stick comprising:

a handle;

a throat adjoining the handle, the throat defining a longitudinal axis; and a head adjoining the throat opposite to the handle, the head curving away from the longitudinal axis and back toward the handle to form a toe, the head beginning at a point where the head first curves away from the longitudinal axis, wherein the throat comprises a playing side having a flat exterior face, a non-playing side having a round exterior face, and two edges between the playing side and the non-playing side, wherein the throat is hollow, wherein in a cross section of the throat taken perpendicularly to the longitudinal axis, the playing side and the non-playing side have a first wall thickness that is substantially constant and the two edges have a second wall thickness, the cross section increasing in thickness from the first wall thickness to the second wall thickness from the playing side to the two edges and from the non-playing side to the two edges, and wherein the second wall thickness is substantially greater than the first wall thickness to provide the field hockey stick with edge weighting.

2. The field hockey stick of claim 1, wherein the second wall thickness is at least 1½ times thicker than the first wall thickness.

3. The field hockey stick of claim 1, wherein the second wall thickness is approximately 1/16" to approximately ¼" thicker than the first wall thickness.

4. The field hockey stick of claim 1, wherein the throat has the cross section for its entire length between the handle and the head.

5. The field hockey stick of claim 1, wherein the cross section is taken approximately 4 inches above the toe.

6. The field hockey stick of claim 1, wherein the field hockey stick comprises a composite field hockey stick.

7. A field hockey stick comprising:

a handle;

a throat adjoining the handle, the throat defining a longitudinal axis; and a head adjoining the throat opposite to the handle, the head curving away from the longitudinal axis and back toward the handle to form a toe, the head beginning at a point where the head first curves away from the longitudinal axis, wherein the throat is hollow, wherein the throat comprises a playing side having a flat exterior face, a non-playing side having a round exterior face, and two edges between the playing side and the non-playing side, wherein in a cross section of the throat taken perpendicularly to the longitudinal axis, the playing side and the two edges have a first wall thickness that is substantially constant and the non-playing side has a second varying wall thickness that increases from the first wall thickness starting at points proximate to the two edges to a maximum wall thickness at approximately a midpoint of the non-playing side, and wherein the maximum wall thickness is substantially greater than the first wall thickness to provide the field hockey stick with back weighting.

8. The field hockey stick of claim 7, wherein the cross section is taken approximately 4 inches above the toe.

9. The field hockey stick of claim 7, wherein the maximum wall thickness of the non-playing side is approximately 1/16" to approximately ¼" thicker than the first wall thickness.

10. The field hockey stick of claim 7, wherein the maximum wall thickness of the non-playing side is at least 1½ times thicker than the first wall thickness.

11. The field hockey stick of claim 7, wherein the head of the field hockey stick is hollow, wherein the head comprises a playing side having a flat exterior face, a non-playing side having a round exterior face, and two edges between the playing side and the non-playing side, wherein in a cross section of the head taken perpendicularly along the curve of the head, the playing side of the head and the two edges of the head have a first head wall thickness that is substantially constant and the non-playing side of the head has a second varying head wall thickness that increases from the first head wall thickness starting at points proximate to the two edges of the head to a maximum head wall thickness at approximately a midpoint of the non-playing side of the head, and wherein the maximum head wall thickness is substantially greater than the first head wall thickness.

12. The field hockey stick of claim 7, wherein the field hockey stick comprises a composite field hockey stick.

* * * * *